US007533438B1

(12) United States Patent
Newell

(10) Patent No.: US 7,533,438 B1
(45) Date of Patent: May 19, 2009

(54) TASSELED WOVEN MOP

(76) Inventor: Robert D. Newell, 65 Weyanoke Cir., Clarksville, VA (US) 23927

( * ) Notice: Subject to any disclaimer, the term of this patent is extended or adjusted under 35 U.S.C. 154(b) by 620 days.

(21) Appl. No.: 11/164,229

(22) Filed: Nov. 15, 2005

Related U.S. Application Data

(60) Provisional application No. 60/628,486, filed on Nov. 16, 2004.

(51) Int. Cl.
*A47L 13/20* (2006.01)

(52) U.S. Cl. ..... 15/229.1; 15/228; 15/229.2; 15/229.6

(58) Field of Classification Search ..... 15/228, 15/229.1–229.9
See application file for complete search history.

(56) References Cited

U.S. PATENT DOCUMENTS

| | | | | | |
|---|---|---|---|---|---|
| 828,878 | A | * | 8/1906 | Cleveland | 15/229.1 |
| 2,238,432 | A | * | 4/1941 | Myers | 139/383 R |
| 3,246,356 | A | * | 4/1966 | Sorrells | 15/118 |
| 3,568,234 | A | * | 3/1971 | Komatsu | 15/229.1 |
| 5,638,569 | A | * | 6/1997 | Newell | 15/229.6 |

* cited by examiner

*Primary Examiner*—Mark Spisich
(74) *Attorney, Agent, or Firm*—Ishman Law Firm P.C.

(57) ABSTRACT

A reversible mop includes a rectangular woven center panel forming an array of nodes having tasseled ends extending therebeyond, the materials for the warp material being formed of a hoop sensitive material enabling direct contact mounting of the mop at a mop head in a hook and loop mounting system.

11 Claims, 5 Drawing Sheets

TASSELED WOVEN MOP

RELATED APPLICATION

This application claims the benefit of U.S. Provisional Application No. 60/628,486 filed on Nov. 16, 2004.

FIELD OF THE INVENTION

The present invention relates to a mop for dry and wet removal of surface accumulations.

BACKGROUND OF THE INVENTION

Conventional dry mops for floors typically utilize twisted wool yarn strands deployed in various formats for dislodging and adhering floor accumulations. The adherent properties are generally limited to the frayed ends of the strands and enhanced by natural or impregnated oil content. When the frayed ends are fully loaded, little adherent capacity is provided by the fiber length and remaining accumulations are merely swept to with mop movement. Further, the oil content resists removal by mechanical means, such as shaking, and by washing. Still further, any washing removes oil content reducing the adherent capacity of the mop for reuse.

SUMMARY OF THE INVENTION

The present invention provides an improved dry or wet mop wherein a center band of woven material terminates at each lateral edge at a seam preventing unraveling and exposing tasseled ends. The woven material may comprise fabric strips, yarns, fibers, filaments or the like. The center band of woven material is hook or Velcro sensitive allowing the direct engagement with hook arrays on conventional rigid mop heads. The tasseled ends provide extended surfaces for adhering loose particulate matter. The center band of woven material provides a multiplicity of discretely arrayed scrubbing nodes for removing adherent particulate matter with the pockets therebetween effective for trapping and retaining particulates. The mop material is absorbent allowing the mop to be used in a wet scrubbing mode.

BRIEF DESCRIPTION OF THE DRAWINGS

The above and other features and advantages of the present invention will become apparent upon reading the following description taken in conjunction with the accompanying drawing in which.

DESCRIPTION OF THE PREFERRED EMBODIMENTS

Figure 1:
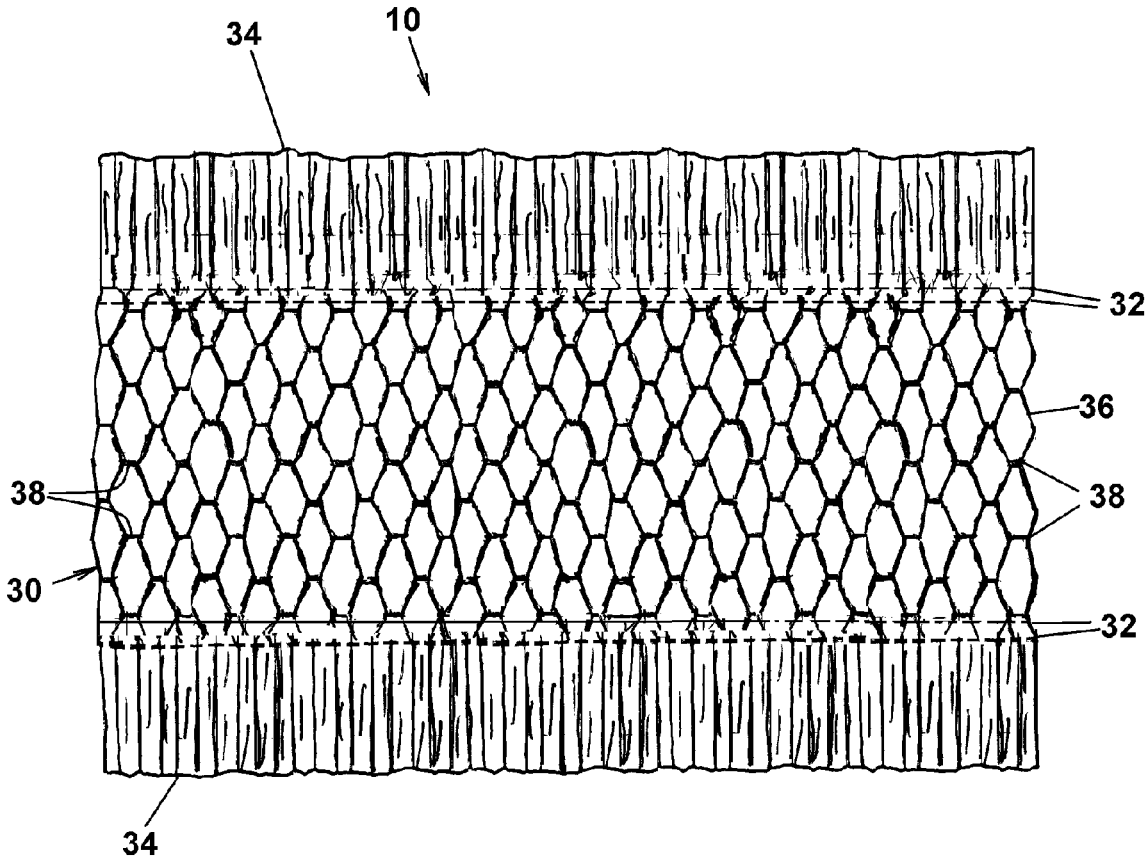
FIG. 1 is a top view of a tasseled woven mop formed with non-woven fabric strips in accordance with an embodiment of the invention.

Referring to FIG. 1, there is shown a reversible, tasseled woven mop 10 that is adhered in direct contact at hook and loop sensitive mounting to a mop head assembly 12 for use as a wet or dry system for removing loose or adherent particulates from a flat surface, such as a floor.

Figure 2:
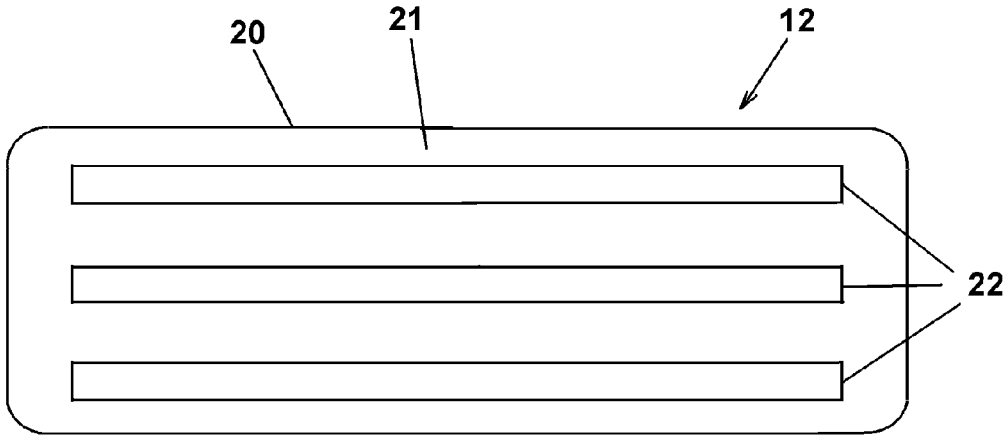
FIG. 2 is a bottom view of a direct contact mop head for attachment to the mop of FIG. 1.
Figure 3:
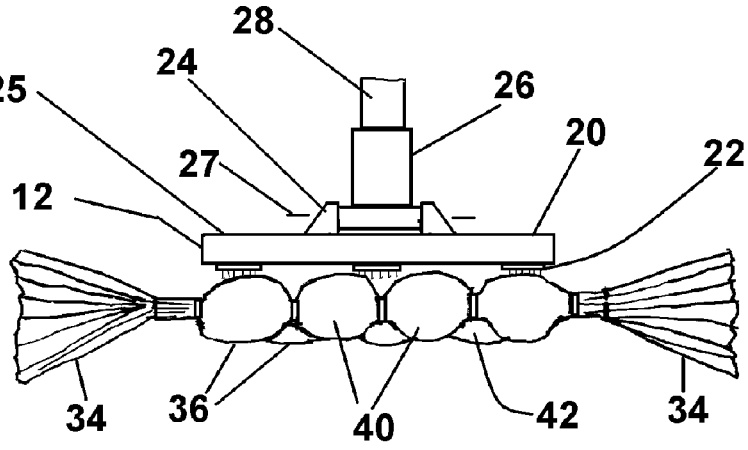
FIG. 3 in an end view of the mop of FIG. 1 mounted at the mop head of FIG. 2.

Referring to FIGS. 2 and 3, the mop head assembly 12 has a rectangular mop head body 20 having a bottom surface 21 provided with transversely spaced lateral hook strips 22 having arrays of downwardly projecting barbs or hooks adapted to engage opposed compatible material in a hook and loop, or Velcro sensitive, attaching system. The body 20 has a pair of laterally spaced flanges 24 on a top surface 25 to which a swivel assembly 26 is pivotally attached for rotation about a lateral axis 27. The upper end of the swivel assembly 26 is attached to a mop handle 28. Suitable mop head assemblies are widely commercially available.

The mop 10 is a woven construction having a center, generally rectangular, woven panel 30 having laterally spaced sides and longitudinally spaced ends. The sides having lateral retaining stitches 32 terminating in longitudinal bands of outwardly extending tassels 34, without weft material, at the sides. The top and bottom surfaces of the mop are substantially identical such that the mop may be reversed on the mop head 12 thereby providing dual cleaning surfaces prior to washing or discard.

Figure 4:
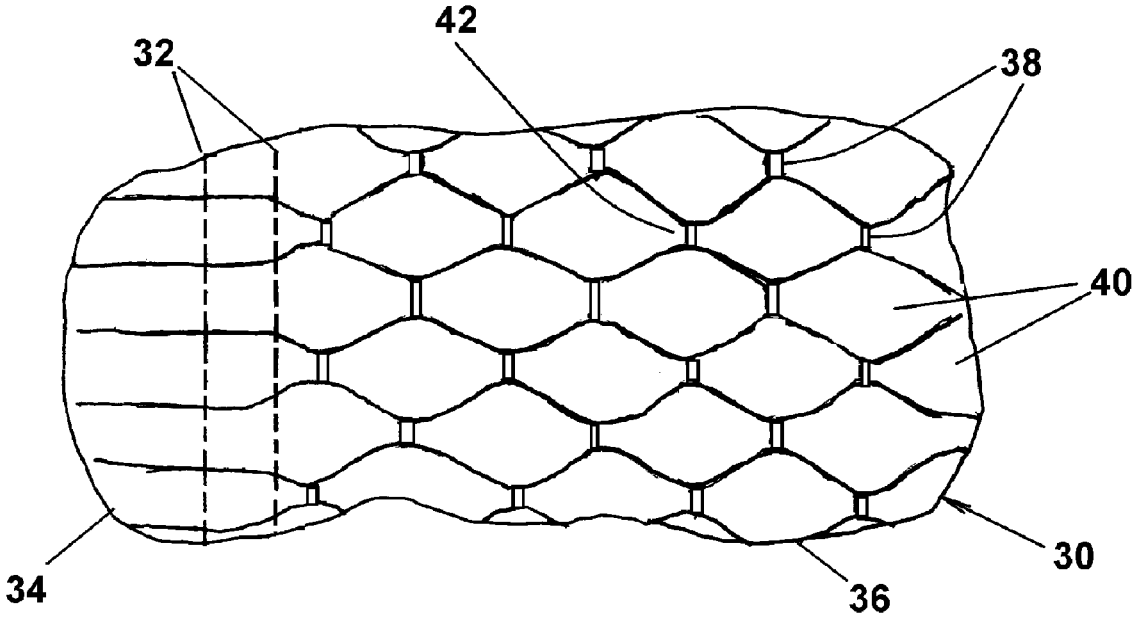
FIG. 4 is an enlarged fragmentary top view of the center woven panel of the mop of FIG. 1.

As shown in FIGS. 1 and 4, the woven panel 30 comprises compacted bundles 36 of warp material interconnected with bands 38 of weft material in strip, filament or thread form providing an interconnected woven array of compacted nodes 40 that present scrubbing surfaces at the peripheries thereof and particulate retaining pockets 42 therebetween. The stitches 32 serve to prevent unraveling of the woven panel 30. The tassels 34 may be formed by unraveling the weft, manually or mechanically, after stitching and cutting the weaving to size. Alternatively, the tassels 34 may be directly formed in the weaving process by elimination of the weft at the tassels as described below.

Figure 5:
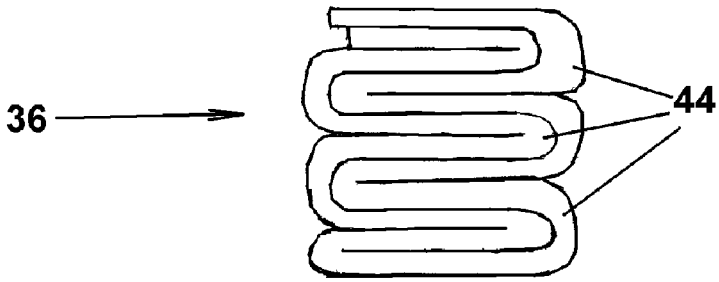
FIG. 5 is an end view of the pleated warp bundle.

As shown in FIG. 5, the bundles 36 and tassels 34 are formed of gathered pleats 44 of warp material comprising folded non-woven planar material. A suitable fabric is a spun laced bonded blend of polyester available as Softesse or Sontara spunlaced fabric label from E. I DuPont De Nemours. The fabric in the woven form is hook sensitive and adherent to the hooks of the mop strips 22 in a hook and loop type fastening system. The fabric in strip form is gathered by conventional means into a multiplicity of pleats 44 to form the warp bundle 36. The pleats 44 may be twisted prior to weaving for forming more compact nodes. After the lateral stitching 32, the pleats readily untangle to present expanded surfaces for adhering and entrapping particulates. The pleats bloom multi-directionally to form an extensive array of surfaces, folds and pockets for adhering and retaining particulates. By way of example, the tassels are about 2 inches in length formed from strip material of about 8 inches in length with gathered pleats of between ¼ to ½ inches in width. Greater detail on the blooming is shown in the photographic views of the above U.S. Provisional Application No. 60/628,486, which is hereby incorporated by reference.

Figure 6:
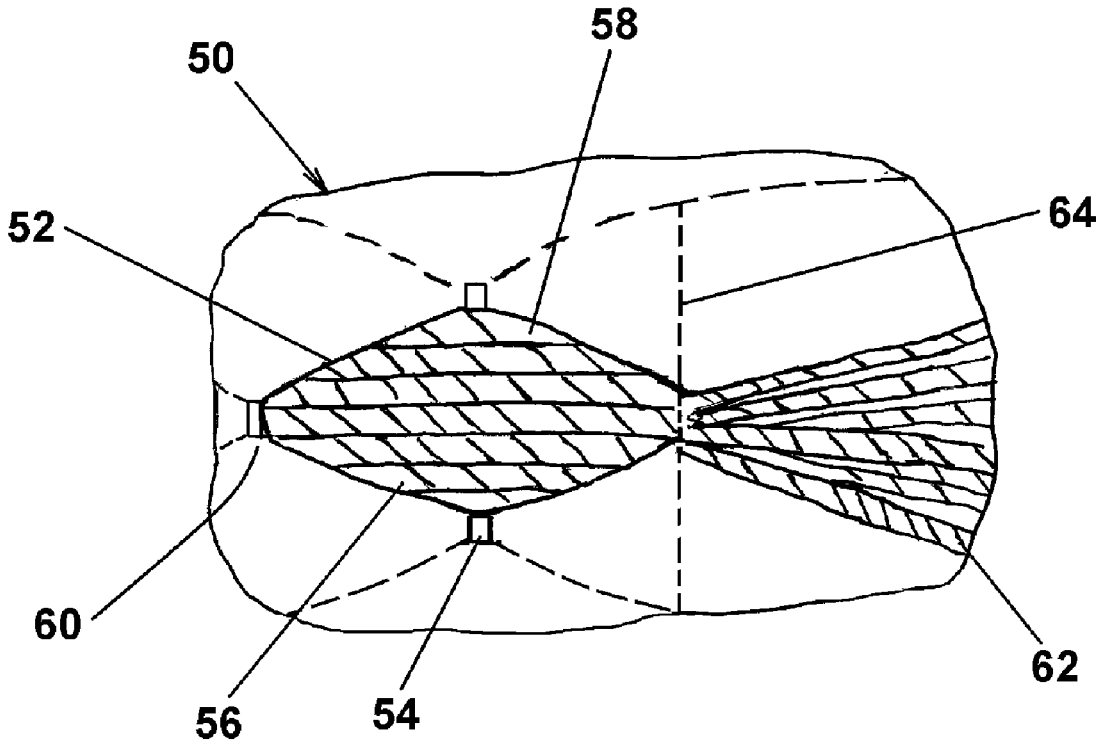
FIG. 6 is a top view of a tasseled woven mop formed with twisted filament yarn bundles in accordance with another embodiment of the invention.
Figure 7:
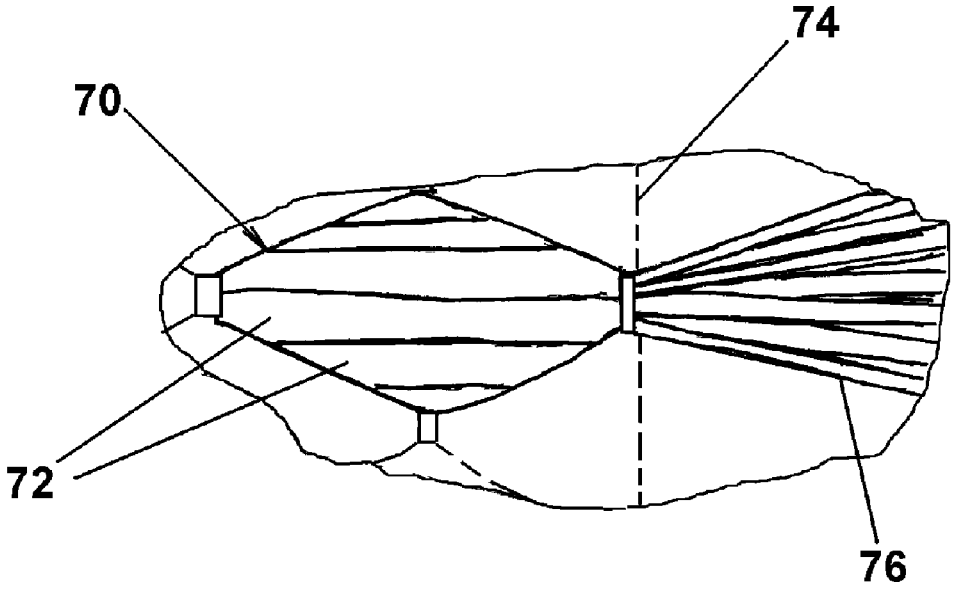
FIG. 7 is a top view of a tasseled woven mop formed with filament strand bundles in accordance with another embodiment of the invention.

Another embodiment is shown in FIG. 6 wherein the mop is comprised of a center woven panel 50 with warp bundles 52 and weft bands 54. The warp bundles are formed of multiple twisted yarns, filaments or thread strands 56. The bundles 52 are tightly compacted during weaving to form an array of scrubbing nodes 58 with pockets 60 therebetween. The tasseled ends 62 beyond the lateral retaining stitching 64 present extended surfaces for particle removal. A further embodiment is shown in FIG. 7 wherein the mop 70 is comprised of warp bundles 72 of discrete filaments terminating beyond the lateral retaining stitching 74 with tasseled ends 76. Preferred materials are synthetic filaments, preferably polyester, having between 1 to 1,000 filaments/denier. Testing has determined that the filament nodes provide direct tenacious adherence to the hook strips 22.

The mops as above described may be made from filament yarns, fabrics and rolled goods that are woven, non-woven, or knitted materials and that can be slit and trimmed to form the gathered pleats and bundles. Suitable materials include polyester, polypropylene, polyethylene, wood pulp, rayon, cotton, nylon, olifin, plastic sheeting, fibrillated yarn, and rubberized materials. Non-woven materials without a distinct hoop or loop structures have been determined to be hook sensitive surfaces in the described woven format. Examples include needle punched materials, melt bonded hydro-entangled apertured bonded construction or with loosely adhered fiber materials.

Figure 8:
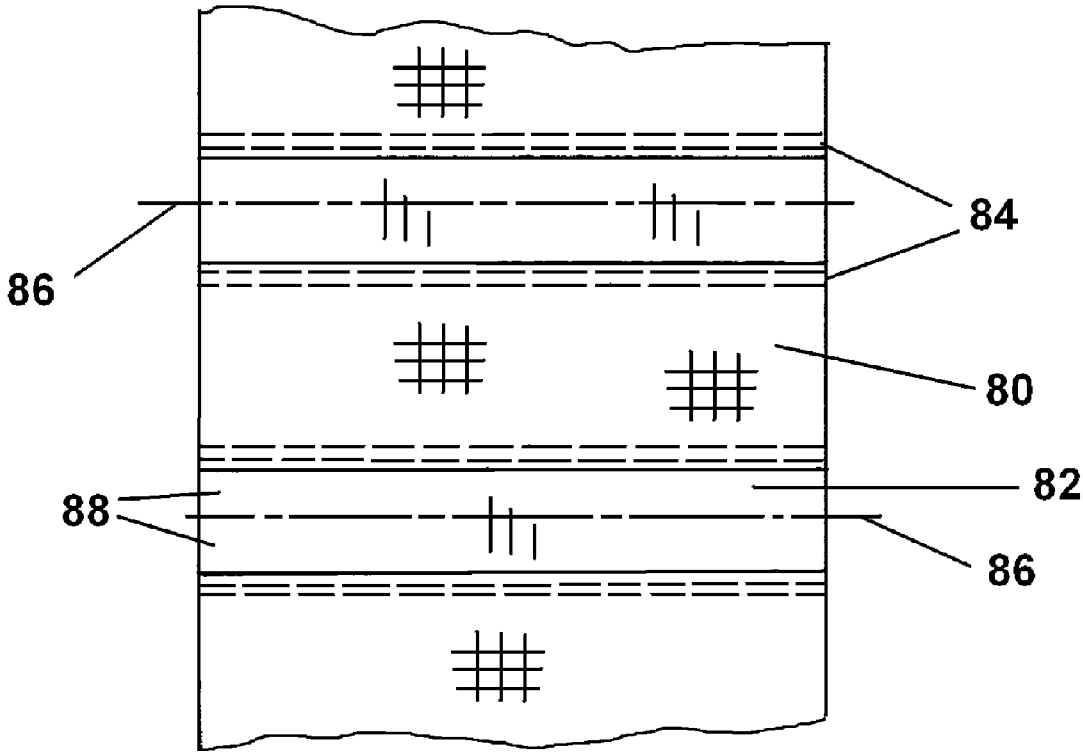
FIG. 8 is a schematic view of a method for making a tasseled woven mop.
Figure 9:
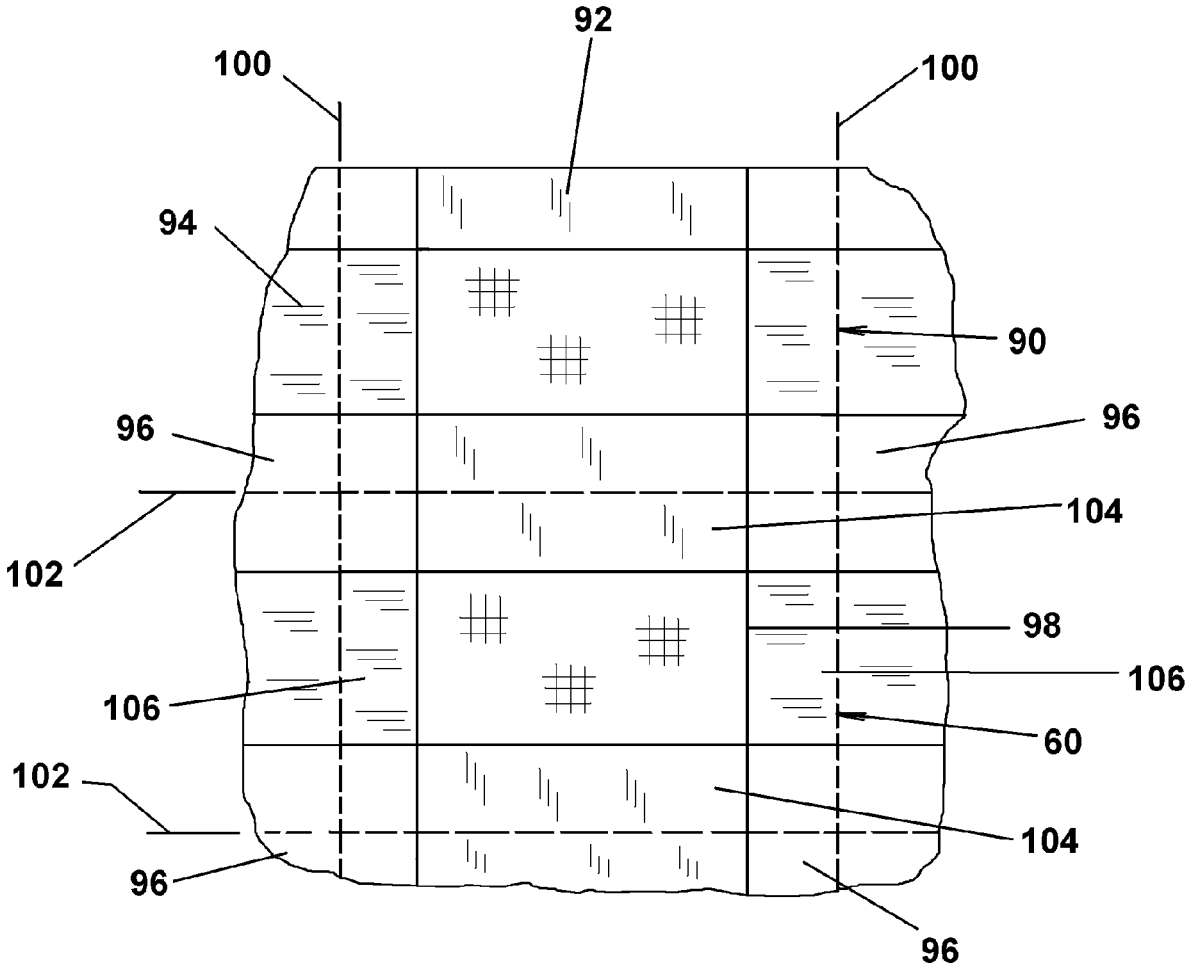
FIG. 9 is a schematic view of another method for making a tasseled woven mop.

The mops described above may be made in the format shown in FIG. 8. In a continuous process on Draper loom, a woven panel comprises fully woven bands 80 separated by non-woven bands 82 without weft or cross threads and thus comprised entirely of non-tangled warp stands. After weaving, the cross-stitching 84 is applied to the lateral sides of the woven bands. Thereafter, the non-woven bands are laterally severed at dashed line 86 thereby forming the tassels 88 that do not require manual or mechanical untangling.

Additionally, the mops 90 may be formed on a Dornier loom or e/Draper loom. Therein, the warp strands 92 and the weft strands 94 are in the above described bundle format. The warp strands and weft strands are omitted in the corner areas 96 surrounding a rectangular woven panel 98. The woven article is then longitudinally severed along lines 100 and laterally severed along lines 102 resulting in the mop having the woven panel 98 with tasseled side fringes 104 and tasseled end fringes 106.

It has also been determined that by adding tension to the cross threads and reducing tension on the warp strands, an increased rippling of the nodes is produced creating increased localized friction for scrubbing and with deep pockets therebetween for retaining liquids and particulates. It has also been determined that the increased surface areas of the tassels increase the static field, particularly with petroleum based material, increasing particulate adherence. The non-linting characteristics of needle punched non-woven fabrics blended with fabrics or thread yarns reduces material loss and extends the useful life of the mops.

The above mops are effective for dry mopping wherein the tassels are effective form removing and entrapping loosely adherent material and the nodes with normal or assisted force on the mop head are effective for dislodging adherent material. When one surface of the mop is soiled, the mop may be reversed to present the other surface. The mop may be cleaned by shaking and/or washing, or discarded after use. The secure woven format allows repetitive washing and can improve functionality through fiber softening. For wet mopping, the mop may be immersed in a cleaning liquid, or otherwise wetted and thereafter used to remove surface accumulations in a wet mode.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claim.

What is claimed is:

1. A reversible mop for mounting on a mop head having a hooked surface, comprising: a mop body comprising a rectangular center panel having laterally spaced sides and longitudinally spaced ends, said center panel formed of longitudinal bundles of warp material woven with weft material to establish an array of nodes, the bundles being longitudinally stitched at said sides to retain said nodes and extending in lateral bands therebeyond with any weft material being removed from said lateral bands to establish tasseled ends, the nodes of the warp material being effective to establish a hook and loop fastening system with said hooked surface of said mop head for direct contact mounting of the mop body thereon wherein said ends of said woven panel are laterally stitched and said weft material extends therebeyond in longitudinal bands with any warp material being removed to establish tasseled ends.

2. The reversible mop as recited in claim 1 wherein said bundles are formed of pleated strips of planar material.

3. The reversible mop as recited in claim 2 wherein said planar material is selected from non-woven fabrics.

4. The reversible mop as recited in claim 3 wherein said non-woven fabric are selected from needle punched and melt bonded fabrics.

5. The reversible mop as recited in claim 1 wherein said bundles are formed of synthetic filaments.

6. The reversible mop as recited in claim 5 wherein said synthetic filaments are polyester.

7. The reversible mop as recited in claim 1 wherein said weft material is formed of the same material as said warp material.

8. A reversible mop assembly comprising: a mop head having an array of hooked surfaces for a hook and loop fastening system; a mop body having a center panel formed of longitudinal bundles of warp material woven with weft material to establish an array of nodes, at least one of said materials being a non-woven material effective for establishing the loops of said hook and look fastening system whereby said mop head is attached to said nodes by a direct contact connection, the center panel including peripheral stitching to retain said nodes, said warp material extending outwardly from said stitching to establish lateral tasseled ends.

9. A reversible mop assembly comprising: a mop head having an array of hooked surfaces for a hook and loop fastening system; a mop body having a center panel formed of longitudinal bundles of warp material woven with weft material to establish an array of nodes, the center panel including peripheral stitching to retain said nodes, said warp material extending outwardly from said stitching to establish lateral tasseled ends wherein said warp material is formed of non-woven planar hook sensitive fabric strips folded into overlapping pleats, said pleats blooming multi-directionally to present expanded surfaces for adhering and entrapping particulates and said nodes providing scrubbing surfaces with spaces therebetween for retaining particulates, said weft material at said nodes being effective for establishing the loops of said hook and look fastening system whereby said mop head is attached to said nodes by a direct contact connection.

10. The mop assembly as recited in claim 9 wherein said fabric strips are formed of non-woven materials without distinct hoop or loop structures selected from the group consisting of needle punched materials, melt bonded materials, hydro-entangled materials, and apertured bonded materials.

11. The mop assembly as recited in claim 9 wherein said weft material is woven with a lesser tension than said warp material thereby producing increased rippling of said nodes creating increase localized friction for scrubbing and deeper spaces therebetween for retaining liquids and particulates.

* * * * *